US005878145A

United States Patent [19]

Adams

[11] Patent Number: 5,878,145

[45] Date of Patent: Mar. 2, 1999

[54] ELECTRONIC CIRCUIT AND PROCESS FOR CREATION OF THREE-DIMENSIONAL AUDIO EFFECTS AND CORRESPONDING SOUND RECORDING

[75] Inventor: Robert W. Adams, Acton, Mass.

[73] Assignee: Analog Devices, Inc., Norwood, Mass.

[21] Appl. No.: 661,483

[22] Filed: Jun. 11, 1996

[51] Int. Cl.[6] ..... H04R 5/00

[52] U.S. Cl. ..... 381/7; 381/1

[58] Field of Search ..... 381/1, 17–24

[56] References Cited

U.S. PATENT DOCUMENTS

| | | | |
|---|---|---|---|
| 4,118,599 | 10/1978 | Iwahara et al. | 381/1 |
| 4,308,423 | 12/1981 | Cohen . | |
| 4,309,570 | 1/1982 | Carver | 381/1 |
| 4,603,429 | 7/1986 | Carver . | |
| 4,696,035 | 9/1987 | Torelli et al. | 381/1 |
| 4,748,669 | 5/1988 | Klayman . | |
| 4,837,824 | 6/1989 | Orban | 381/1 |
| 4,841,572 | 6/1989 | Klayman . | |
| 4,866,774 | 9/1989 | Klayman . | |
| 4,868,878 | 9/1989 | Kunugi et al. | 381/1 |
| 5,026,051 | 6/1991 | Lowe et al. . | |
| 5,046,097 | 9/1991 | Lowe et al. . | |
| 5,052,685 | 10/1991 | Lowe et al. . | |
| 5,105,462 | 4/1992 | Lowe et al. . | |
| 5,208,860 | 5/1993 | Lowe et al. . | |
| 5,272,274 | 12/1993 | Kimura | 381/63 |
| 5,371,799 | 12/1994 | Lowe et al. . | |
| 5,384,851 | 1/1995 | Fujimori | 381/17 |
| 5,412,731 | 5/1995 | Desper . | |
| 5,436,975 | 7/1995 | Lowe et al. . | |

*Primary Examiner*—Curtis A. Kuntz
*Assistant Examiner*—Ping W Lee
*Attorney, Agent, or Firm*—Wolf, Greenfield & Sacks, P.C.

[57] ABSTRACT

Acoustic signals received by the ears are controlled by feeding back and filtering the signal to be applied to the speaker, rather than by use of a feedforward filter. The feedback filter may incorporate an electrical model of the speaker-to-ear transfer function to force the ear signals to a desired ratio of amplitudes and phases as a function of the frequency. The signals to be output to the right and left channels are fed back through a filter to obtain a feedback signal. The feedback signal is subtracted from one input channel and added to the other input channel to provide the output signals. This technique may be used both in stereo spreading and in three-dimensional localization of a monaural sound source. By using feedback instead of feedforward, the system can be readily adapted to different playback environments. Through a simple adjustment of the electrical model of the speaker-to-ear transfer functions, this system automatically provides the desired ear signals. Since the adjustment simply changes a model, it is possible dynamically to adapt the model to suit the position of the listener. For a simple low-cost stereo spreading system, the filter can be a simple feedback system where several transfer functions are reduced to a single filter.

18 Claims, 10 Drawing Sheets

F1 = (H2/H1) - (Hright/Hleft)

F2 = 1 - (H2/H1)*(Hright/Hleft)

ELECTRONIC CIRCUIT AND PROCESS FOR CREATION OF THREE-DIMENSIONAL AUDIO EFFECTS AND CORRESPONDING SOUND RECORDING

FIELD OF THE INVENTION

The present invention is related to circuits and processes for creating three-dimensional audio effects, typically using two audio speakers.

BACKGROUND OF THE INVENTION

There are generally two classes of three-dimensional sound manipulation. The first class of manipulation involves processing of conventional recordings to create a wider sense of spaciousness, with sounds apparently emanating from beyond the position of the loud speakers. Such systems include the "SRS system," described in U.S. Pat. Nos. 4,748,669, 4,841,592 and 4,886,774, assigned to Hughes Aircraft Company, the "spatializer" products marketed by Desper Products, such as described in U.S. Pat. No. 4,308,423 (to Joel Cohen) and U.S. Pat. No. 5,412,731 (assigned to Desper Products, Inc.), the QSound System, described in U.S. Pat. Nos. 5,026,051, 5,046,097, 5,052,685, 5,105,462, 5,208,860, 5,371,799 and 5,436,975 (assigned to QSound Ltd.), and a system described by Robert W. Carver in U.S. Pat. Nos. 4,603,429 and 4,309,570. The techniques used in these systems are commonly referred to as "stereo spreading."

The second class of sound manipulation involves the arbitrary placement of single or multiple mono sound sources. This allows a computer to dynamically change the apparent location of sound. This technique involves more exact modeling of the human ear system, and in general requires a digital signal processor to implement localization filters.

The techniques of the first class of three-dimensional sound manipulation generally use a form of feedforward signal processing. For example, in the system described by Carver, an anti-phase electrical cross-coupling signal is introduced to eliminate cross-coupling between right channel signals which reach the left ear and left channel signals which reach the right ear. The anti-phase signal is designed to match the ratio of the transfer function from the speaker to the near ear to the transfer function from the speaker to the far ear. This introduction of an anti-phase electrical cross-coupling signal typically involves a delay of about two hundred microseconds and a frequency response roll off above one kilohertz. By canceling the cross-coupling paths, a signal that comes from the right speaker appears to be farther to the right only because the sound at the left ear is reduced in amplitude. There are several drawbacks to this technique. One is that room acoustics prevent effective cancellation because the sound arriving at the opposite ear is composed not only of sounds traveling along the path from the speaker to the opposite ear, but also includes sound reflected from walls or other objects in the room. Another drawback is that the electrical frequency response of a system using cross-cancellation is not flat, and this causes a sound reproduction to sound hollow.

In the "spatializer" system, rather than using cross-cancellation, a difference signal is derived by subtracting the right input from the left input. This difference signal is fed forward through a signal processing block consisting of a delay and low pass filter. The output of this filter is added to one channel and subtracted from the other channel. For monaural signals, the difference signal component is zero; therefore no processing takes place. Since most of the bass and lead vocal signals are panned to the center, frequency response aberrations which may occur in the Carver system generally do not occur in the "spatializer" system. For signals that appear in the left or right channels only, however, the frequency response is affected. This system works by shifting the phase of low frequencies between the ears. Since the primary localization mechanism below 0.5 kilohertz is inter-aural phase, images outside of the speakers can be obtained by increasing this phase shift. A drawback of this system is that it is optimized by trial-and-error selection of filter components. While it is easy to derive the ear response for a particular set of filter components, it is more difficult to start with the specification of the desired ear response and to derive the required filter components.

SUMMARY OF THE INVENTION

The present invention improves the control of ear signals by using a feedback rather than feedforward filter by feeding back and filtering the signal to be applied to the speaker. The feedback filter may incorporate an electrical model of the speaker-to-ear transfer function to force the ear signals to a desired ratio of amplitudes and phases as a function of the frequency. This technique may be used both in stereo spreading and in three-dimensional localization of a monaural sound source.

By using feedback instead of feedforward, the system can be readily adapted to different playback environments. For example, in a car, a driver typically sits off-center from the speakers. Through a simple adjustment of the electrical model of the speaker-to-ear transfer functions, this system automatically provides the desired ear signals. Since the adjustment simply changes a model, it is possible dynamically to adapt the model to suit the position of the listener. For example, in a car, it is possible to have a switch that optimizes the three-dimensional effect for several different listening positions.

For a simple low-cost stereo spreading system, the filter can be a simple feedback system where several transfer functions are reduced to a single filter. In this case the ability to dynamically adapt the filter is reduced.

Accordingly, one aspect of the invention is a circuit for spatializing an audio signal defined by a first input signal and a second input signal to provide a spatialized output audio signal. This circuit includes a first adder having a signal input connected to receive the first input signal, a feedback input and an output. A second adder has a signal input connected to receive the second input signal, a feedback input and an output. A filter has a first input connected to the output of the first adder, a second input connected to the output of the second adder, a first output connected to the feedback input of the first adder and a second output connected to the feedback input of the second adder. The outputs of the first and second adders provide the output audio signal. Thus, the output signals are the sum of the input signals and filtered and fed back output signals.

In one embodiment, the filter, which may define a model of the speaker-to-ear transfer function, includes a third adder having a first input defining the first input of the filter, a second input defining the second input of the filter, a feedback input and an output providing the sum of the first input, the second input and the feedback input. The filter includes a second filter having an input connected to the output of the third adder and an output providing a filtered signal. A gain element, which has a gain that may be adjustable, has an input connected to the output of the second filter and an output. A third filter has an input connected to the output of the gain element and an output providing a filtered signal to the feedback input of the third adder.

In another embodiment, the circuit may include a fourth filter having an input connected to the output of the first adder and an output connected to the first input of the third adder. A fifth filter, having filter characteristics similar to the fourth filter, may have an input connected to the output of the second adder and an output connected to the second input of the third adder. In this embodiment, the third filter includes a sixth filter connected to the output of the gain element to provide an output signal and a seventh filter, having filter characteristics similar to the fourth filter, connected to the output of the gain element and providing an output signal, combined with the output signal of the sixth filter to be applied to the feedback input of the third adder. In a simple embodiment, the fourth, fifth and seventh filters are eliminated and replaced by a constant gain such as unity. The sixth filter is also replaced by a constant gain, such that the combined gain of the replaced sixth and seventh filters is a constant gain greater than 2.

Another aspect of the invention feeds back the output signals to only one channel. In this aspect of the invention, a circuit for spatializing an audio signal defined by a first input signal and a second input signal to provide a spatialized output audio signal includes an adder having a signal input connected to receive the second input signal, a feedback input and an output. A filter has a first input connected to receive the first input signal, a second input connected to the output of the adder, and an output connected to the feedback input of the adder. The first input signal and the output of the adder provide the spatialized output audio signal.

Another aspect of the invention is a circuit for processing an audio signal to provide a spatialized output signal, including an adder having a signal input for receiving the audio signal, a feedback input and an output. A filter has a first input connected to the output of the adder, and an output connected to the feedback input of the adder. The output of the adder and the output of the filter provide the spatialized output signal.

In one embodiment of this aspect of the invention, the filter, which may define a model of the speaker-to-ear transfer function, includes a second adder having a first input defining the first input of the filter, a second input defining the second input of the filter input and an output providing the sum of the first input and the second input. The filter also includes a second filter having an input connected to the output of the second adder and an output providing a filtered signal. A gain element, which has a gain that may be adjustable, has an input connected to the output of the second filter and an output providing the output of the filter. The filter also includes a third filter having an input connected to the output of the gain element and an output providing a filtered signal to the second input of the second adder. In a particular embodiment, a third filter is connected to the output of the adder and an output connected to the first input of the second adder.

Another aspect of the invention is a circuit for processing an audio signal to provide a spatialized output signal, wherein the output signals are fed back only to one channel. In this aspect of the invention, a filter has a first input connected to receive the audio signal, a second input, and an output connected to the second input. The audio signal and the output of the filter provide the spatialized output signal.

Other aspects of the invention include the process performed by these circuits to produce spatialized output signals from input monaural and stereo signals.

Other aspects of this invention also include sound recordings produced by spatializing a monaural or stereo signal according to any of the foregoing aspects of the invention. In such a sound recording, the left output signal and the right output signals have a relationship determined by the transfer functions of the feedback filter used in accordance with this invention.

DETAILED DESCRIPTION

The present invention will be more completely understood through the following detailed description which should be read in conjunction with the attached drawings in which similar reference numbers indicate similar structures.

Figure 1:
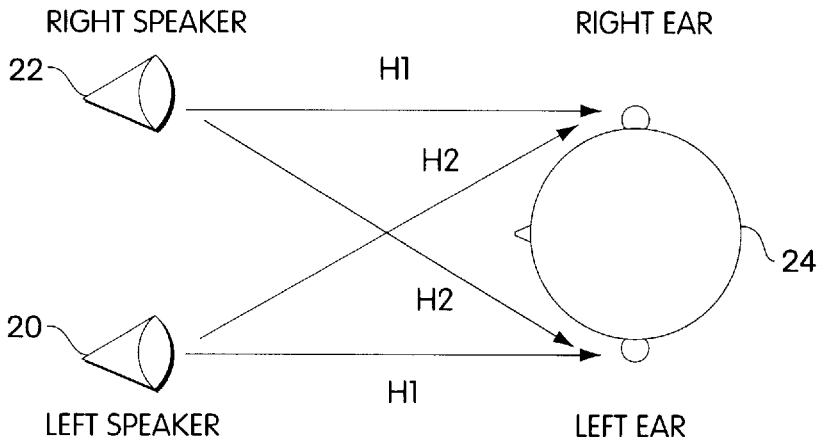
FIG. 1 is an illustration of a symmetrical arrangement of speakers with respect to a listener, indicating acoustic transfer functions.

FIG. 1 shows left and right speakers 20, 22 in a symmetrical arrangement with respect to a listener 24. With such an arrangement, an acoustic transfer function from each speaker 20, 22 to the near ear of the listener 24 (e.g., left speaker 20 to left ear) is denoted as H1, and an acoustic transfer function from each speaker 20, 22 to the opposite ear of the listener 24 (e.g., left speaker 20 to right ear) is denoted as H2. If there were no symmetry, there would be four different acoustic transfer functions.

In some applications it is desirable to manipulate the sound generated by the speakers 20, 22 so that the sound appears to the listener 24 to originate from a location distant from the speakers. A system in accordance with the invention for manipulating sound will now be described.

Figure 2:
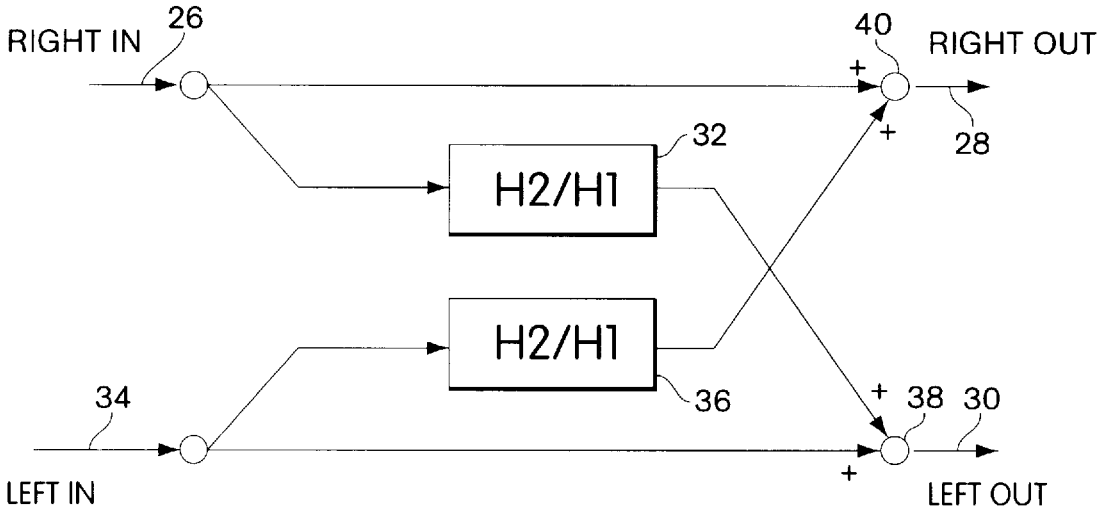
FIG. 2 is a block diagram illustrating cross-cancellation assuming a symmetrical speaker arrangement.

The system in accordance with the invention may use an electrical model of the transfer functions H1 and H2 to perform such manipulation. FIG. 2 shows an electrical model of these transfer functions that preserves amplitude/phase differences between the ears by dividing each path by H1. In particular, a right input signal 26 is applied directly to a right output 28 but to a left output 30 by a factor of H2/H1 as indicated at 32. Similarly, a left input signal 34 is applied directly to the left output 30, but to the right output by a factor of H2/H1 as indicated at 36. The factored right input signal and the left input signal are combined by an adder 38 to produce the left output 30. Similarly, the factored left input signal and the right input signal are combined by adder 40 to produce the right output 28. This electrical model can be used in a closed-loop feedback system because a direct delay-free path through the model ensures that the closed-loop feedback system remains stable.

Figure 3:
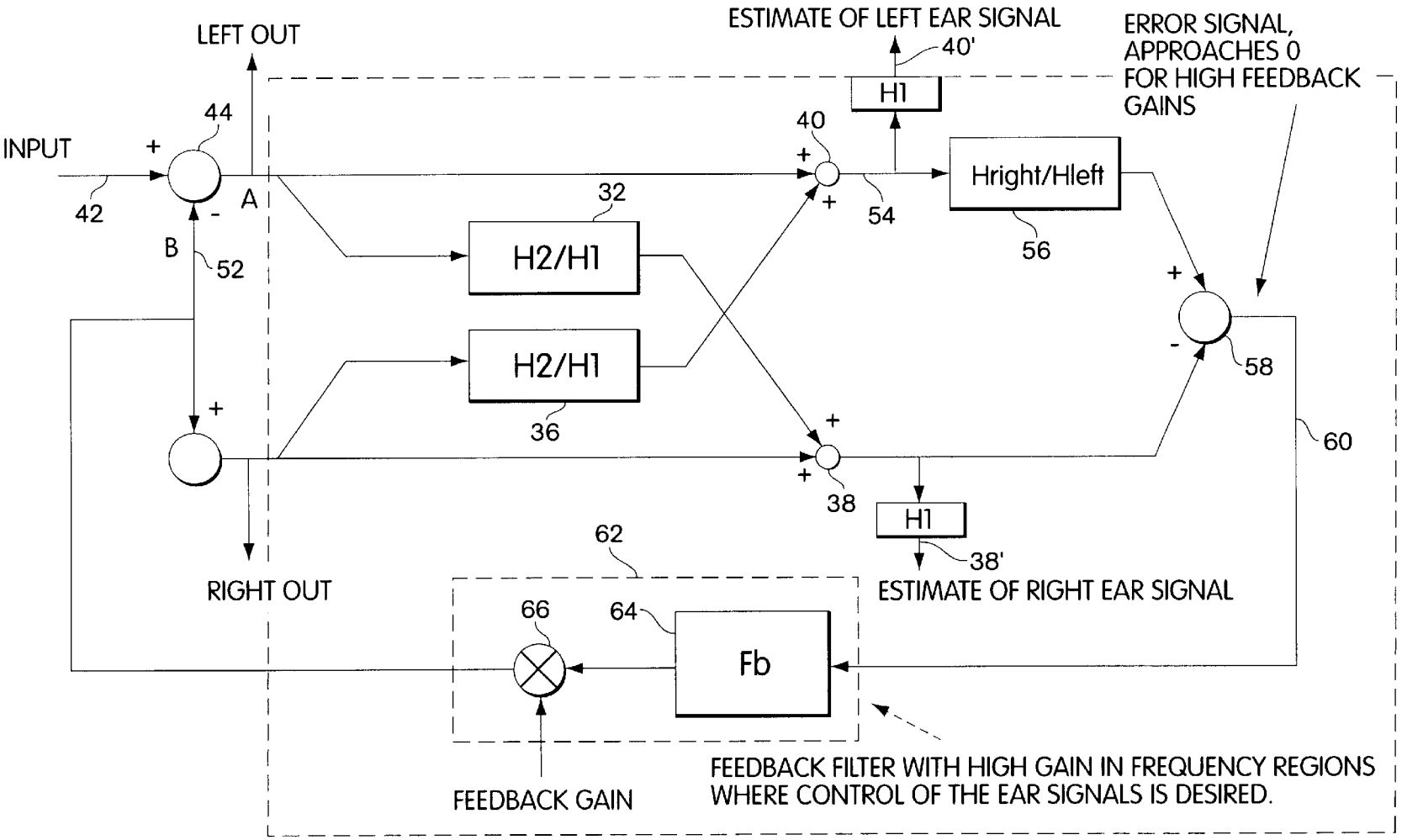
FIG. 3 is a block diagram of a circuit in one embodiment of the invention.

FIG. 3 shows a single-input stereo spreading system using a feedback loop incorporating the electrical speaker-to-ear model of FIG. 2. In this system, the inputs to the electrical model are provided by the left and right output signals to be fed to the speakers or to be recorded. The outputs of adders 40 and 38 are the output of the electrical model. If scaled by H1, as indicated at 40' and 38', these signals would represent an estimate of the acoustic signal at the respective ears of the listener 24. One of the outputs of the model, e.g. output 54, is fed through a transfer function 56 that is the inverse of the desired ratio between the ear signals. An adder 58 receives the filtered model output and the negative of the other model output to generate a difference signal 60. This difference signal is applied to a loop filter 62. The loop filter 62 may be implemented using a filter 64 that acts to stabilize the loop, of which the output is applied to a gain 66. The filter 64 may be designed to have high gain in frequency regions where control of the ear signals is desired. The output of the filter is connected to one (not shown) or both (as shown) of the model inputs to complete the feedback loop.

The operation of the feedback loop can be explained as follows. Assume that the left channel as driven is shown in FIG. 3. The feedback loop will attempt to make the difference signal 60 equal to zero. If the error signal is zero, then:

$$\text{model_out_1}*(\text{Hright/Hleft})-\text{model_out_r}=0,$$

where, model_out_r is the right channel output from adder 38 of the electrical model, model_out_1 is the left channel output from adder 40 of the electrical model, and Hright/Hleft is the desired ratio of the right to left ear signals. In other words:

$$\text{model_out_r}/\text{model_out_1}=\text{Hright/Hleft}.$$

The ratio of the actual ear signals is the same as the ratio of the signals at the model output.

For full three-dimensional localization, the Hright/Hleft transfer function may be quite complex and may involve many peaks and dips in its complex response ratio. On the other hand, for achieving spatialization or stereo spreading, the Hright/Hleft transfer function may be quite simple. For example, the Hright/Hleft transfer function may be a simple delay that is larger than the normal interaural delay between the ears from the speaker itself, which causes the sound to move outside the range of the speakers. Even fairly simple filter functions that do not involve delays are effective in increasing the low-frequency phase difference between the ears.

While the system shown in FIG. 3 only controls the ratio between the ear signals, an additional feedback loop could be used to control the absolute response of the left or right output. Such a system would allow ear signals to be controlled in both ratio and absolute magnitude and phase.

Figure 4:
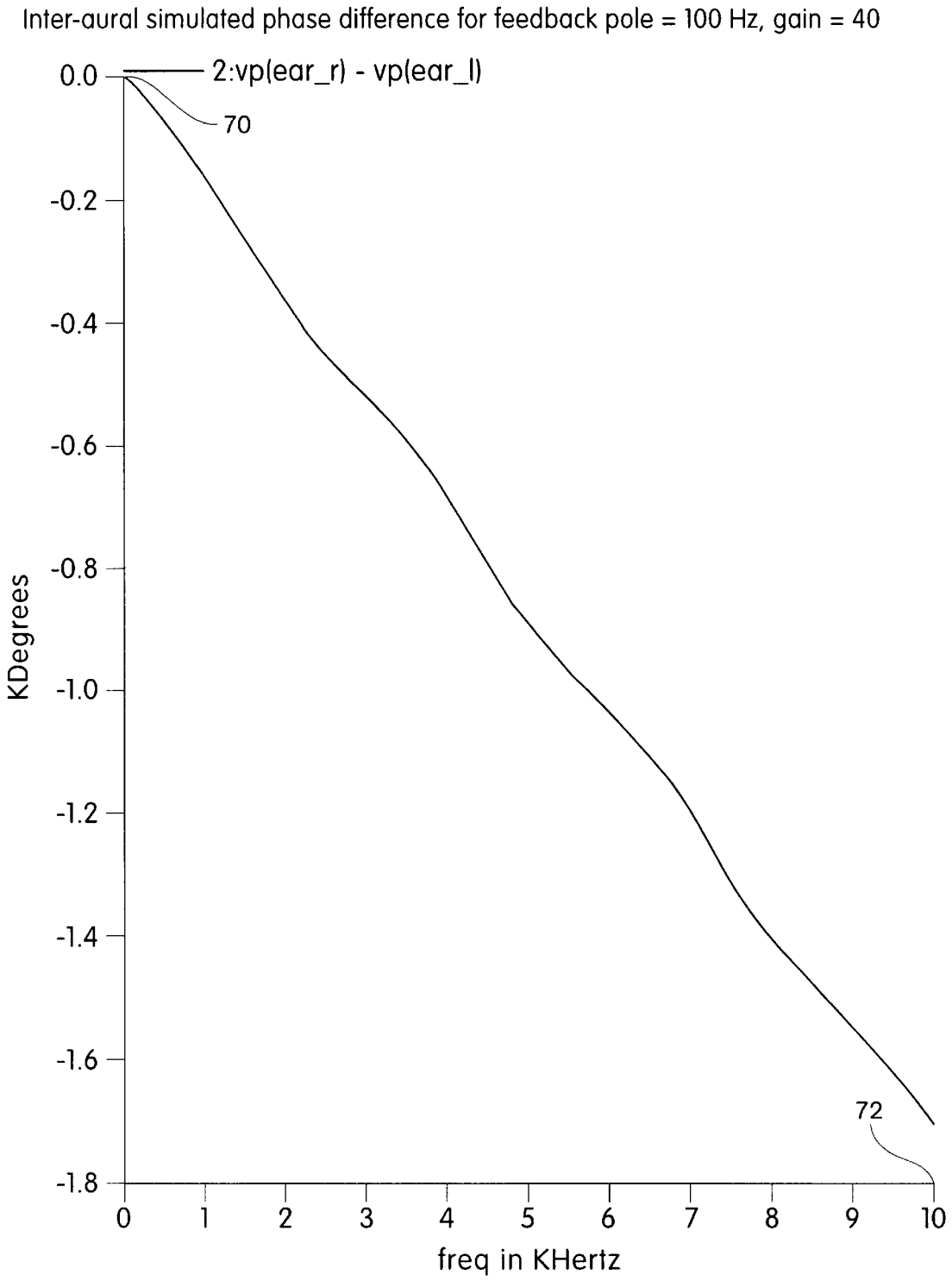
FIG. 4 is a graph illustrating inter-aural simulated phase differences with respect to frequency and kilohertz of the circuit of FIG. 3.

FIG. 4 shows a graph of results of a simulation of the system of FIG. 3, where phase differences between the ear signals are plotted on the ordinate 70 in units of KDegrees as a function of frequency, represented on the abscissa 72 in units of kilohertz. This simulation was performed using:

Hright/Hleft=20-sample delay

Sample rate=44.1 kHz

Feedback filter=DC gain of 40, 1st-order rolloff starting at 100 Hz.

In this simulation, the ear signals are a good approximation of a linear-phase delay corresponding to 40 samples at a clock rate of 44.1 kHz. This result demonstrates that the system is effective at controlling the ratio of the two ear signals.

Figure 5:
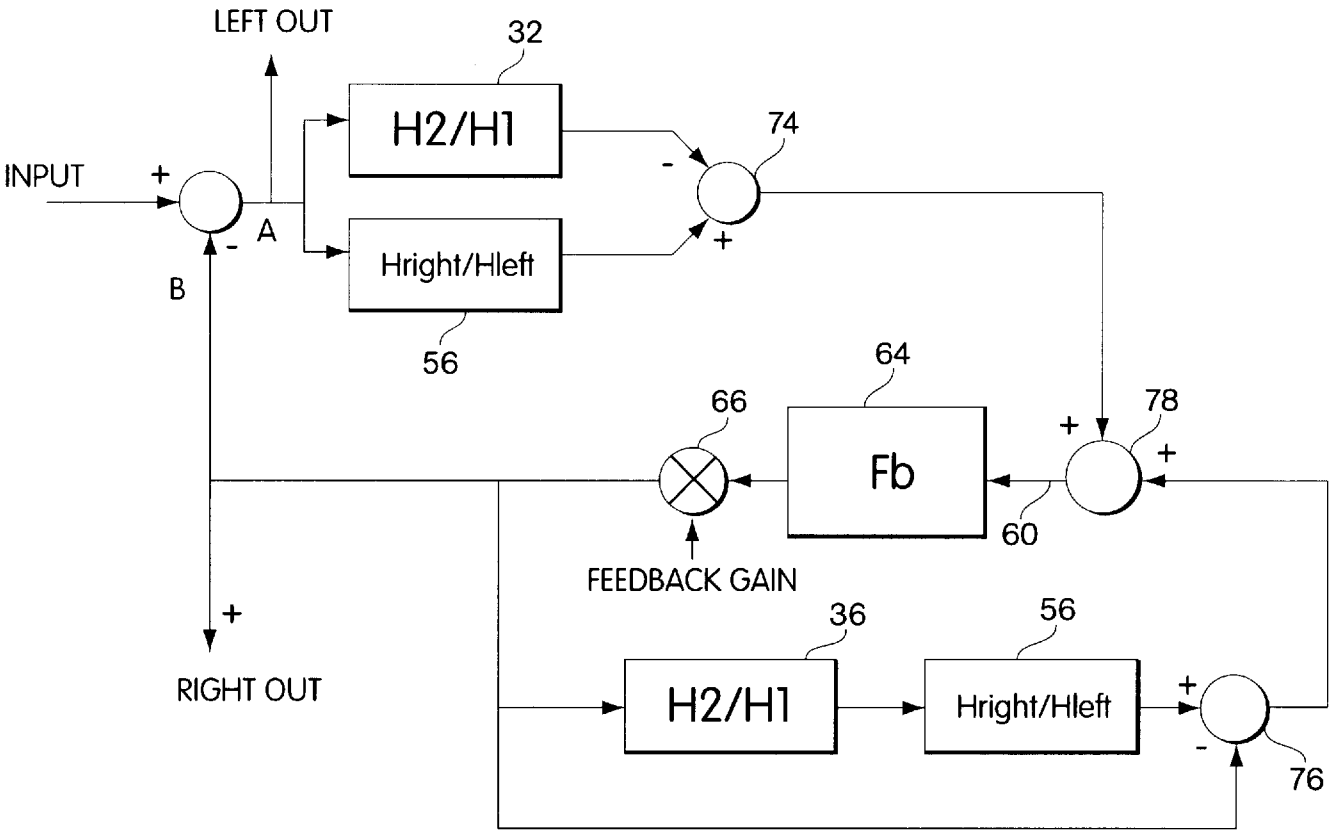
FIG. 5 is a block diagram equivalent to FIG. 3.

FIG. 5 shows an equivalent system to that of FIG. 3. This system may be derived graphically by considering all the feedback loops of FIG. 3. In particular, the left output signal is scaled by the H2/H1 transfer function 32 and by Hright/Hleft transfer function 56. These two signals are subtracted by the adder 58 in FIG. 3. This subtraction is represented by adder 74 in FIG. 5. Additionally, the right output signal is scaled by both the H2/H1 transfer function 36 and the Hright/Hleft transfer function 56. The right output signal is subtracted from this product by adder 58 in producing the difference signal 60. This subtraction is represented by adder 76 is FIG. 5. The outputs of adders 74 and 76 are added by adder 78 to produce the difference signal 60.

Figure 6:
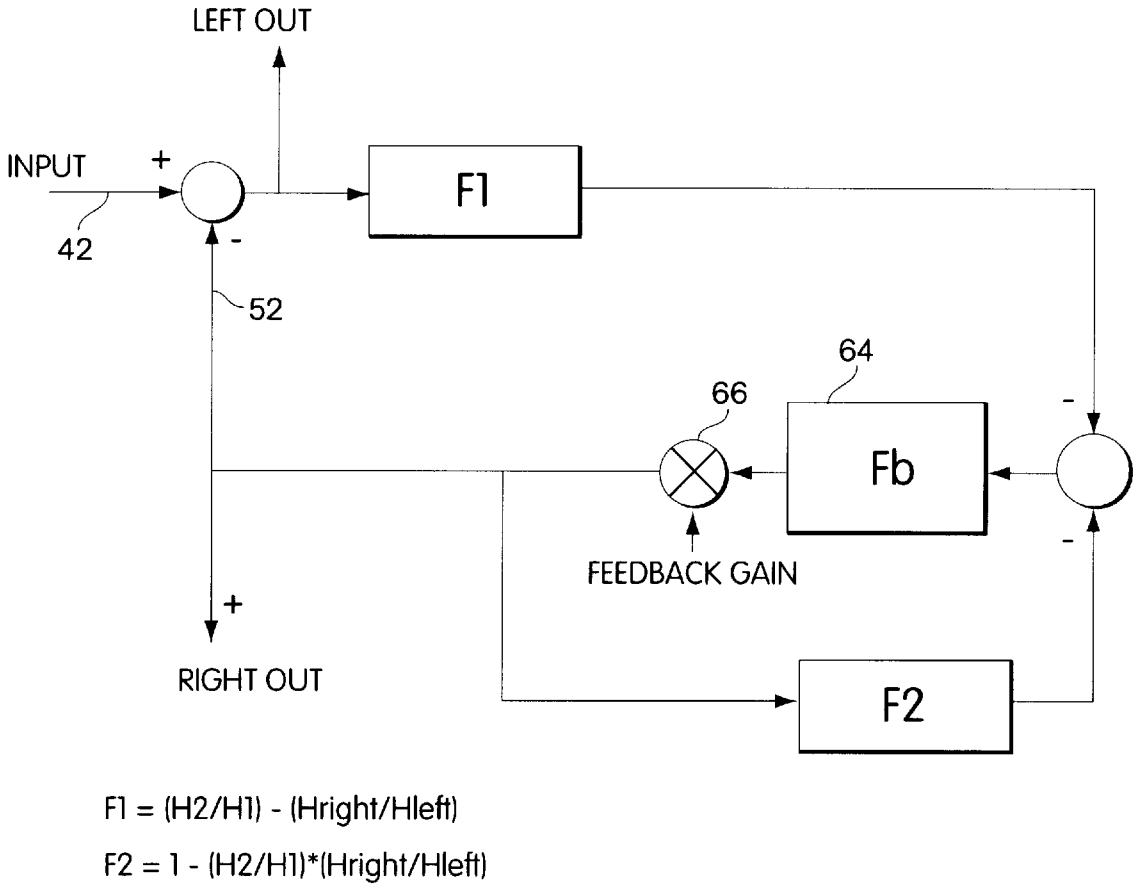
FIG. 6 is a simplified block diagram of FIG. 5.

FIG. 6 shows a further reduction of the circuit of FIG. 5, where there are only three filter functions: F1, F2 and Fb. If the relationship between these filters and the original ear transfer functions is $$F1=(H2/H1)-(Hright/Hleft)$$

$$F2=1-(H2/H1)*(Hright/Hleft),$$

an exact implementation of the system of FIG. 3 is provided.

In the circuits shown in FIGS. 3, 5 and 6, the feedback signal is added to one channel and subtracted from the other. It is also possible to combine the feedback with the opposite channel only, for example by disconnecting the feedback input 52 from the adder 44 in FIG. 3. This system has the advantage that the signal coming from one of the speakers is unchanged, i.e., only one speaker is affected by the processing. This kind of feedback connection may be preferable for systems that localize a mono source by exactly specifying the inter-ear transfer function ratio.

Figure 7:
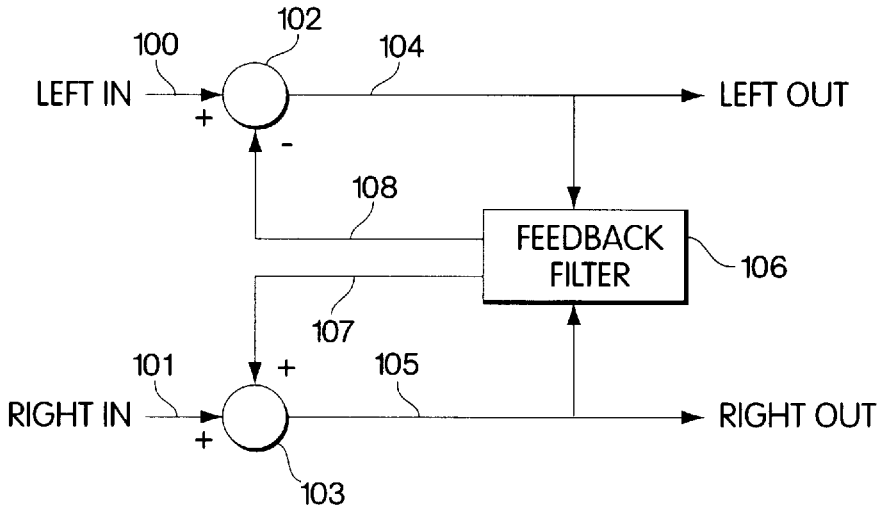
FIG. 7 is a block diagram showing feedback applied to stereo inputs.

FIG. 7 is a stereo implementation similar to the monaural implementation of FIGS. 3, 5 and 6. This system receives a left-in and right-in inputs 100 and 102. The left input is applied to an adder 102 whose output 104 provides the left output signal. A feedback filter 106 receives as one of its inputs the left output signal. One output 108 of the feedback filter 106 is applied to the adder 102 so as to be subtracted from the left input signal 100. Similarly, the right input signal 101 is applied to an adder 103 whose output 105 provides the right output signal. This right output signal is also applied as another input to feedback filter 106. Another output of feedback filter 107 is applied to adder 103 so as to be added to the right input signal 101.

Figure 8:
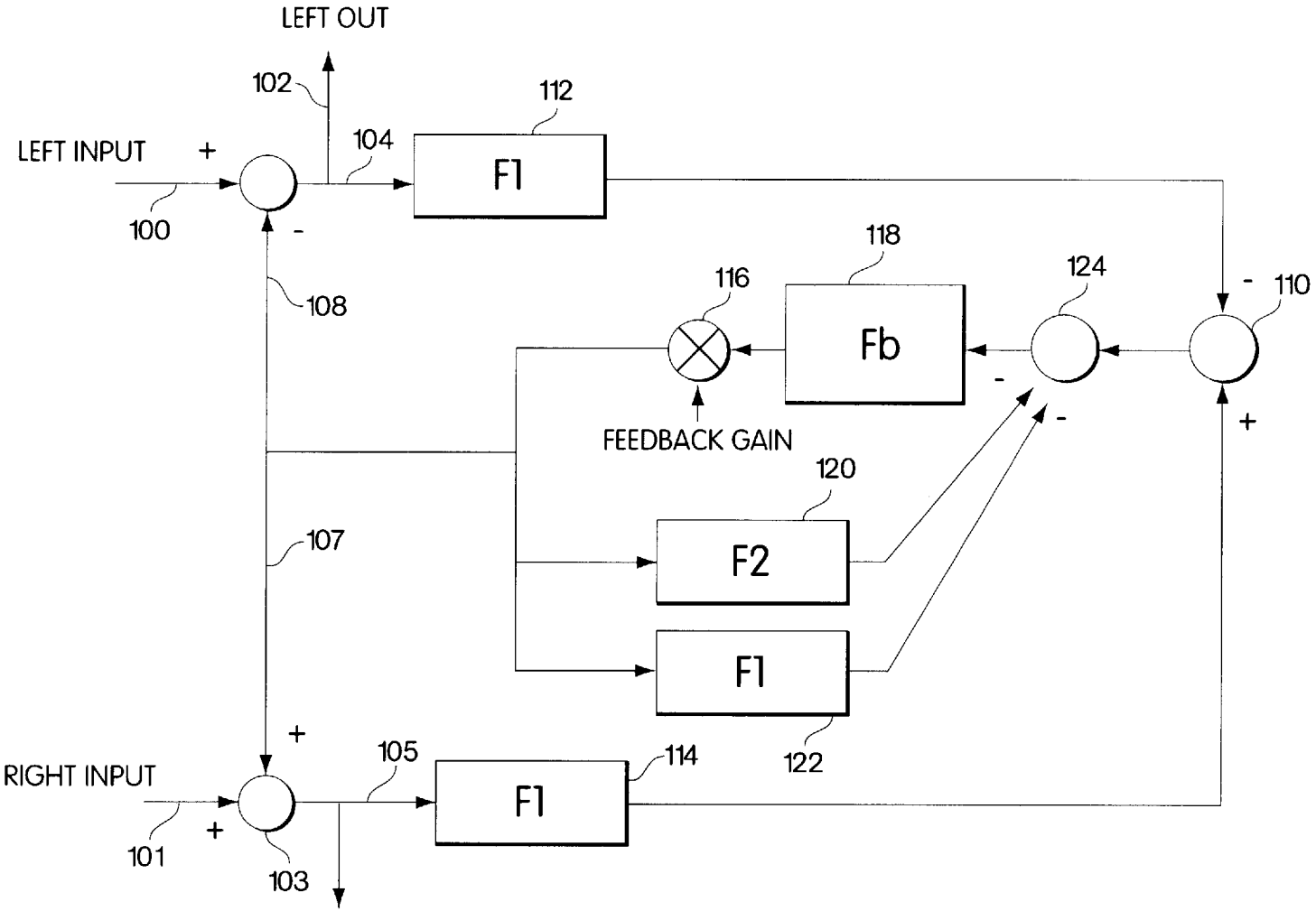
FIG. 8 is a more detailed block diagram of FIG. 7.

The feedback filter 106 may represent a model of the speaker-to-ear transfer functions. For example, the circuit of FIG. 6 can be modified to include cross-coupling between the output channels as shown in FIG. 8, resulting in a stereo application. In particular, a filter F1 is applied to both the left output signal 104 and the right output signal 103 as indicated at 112 and 114. The outputs of these filters are subtracted by an adder 110. The difference of the filtered output signals is applied to a nested feedback loop including the filter Fb 118, gain 116 and filter F2 120. In order to keep the transfer function, for signals that are in the left or right channels only, the same as the transfer function of the system in FIG. 6, an extra feedback filter F1 122 is inserted around the Fb loop to cancel the positive F1 feedback signal caused by adding the second channel. The outputs of filters 120 and 122 are subtracted from the difference of the filtered output signals by adder 124. In the circuit shown in FIG. 8, by taking the difference between filtered output signals, the feedback signal is eliminated when the left and right outputs are equal. This provides a gradual increase in the stereo spreading effect as the input signals move from the center towards either speaker. This cancellation would not occur if the feedback signal were not added to one input of the electrical speaker-to-ear model and subtracted from the other, as shown in FIG. 3.

Figure 9:
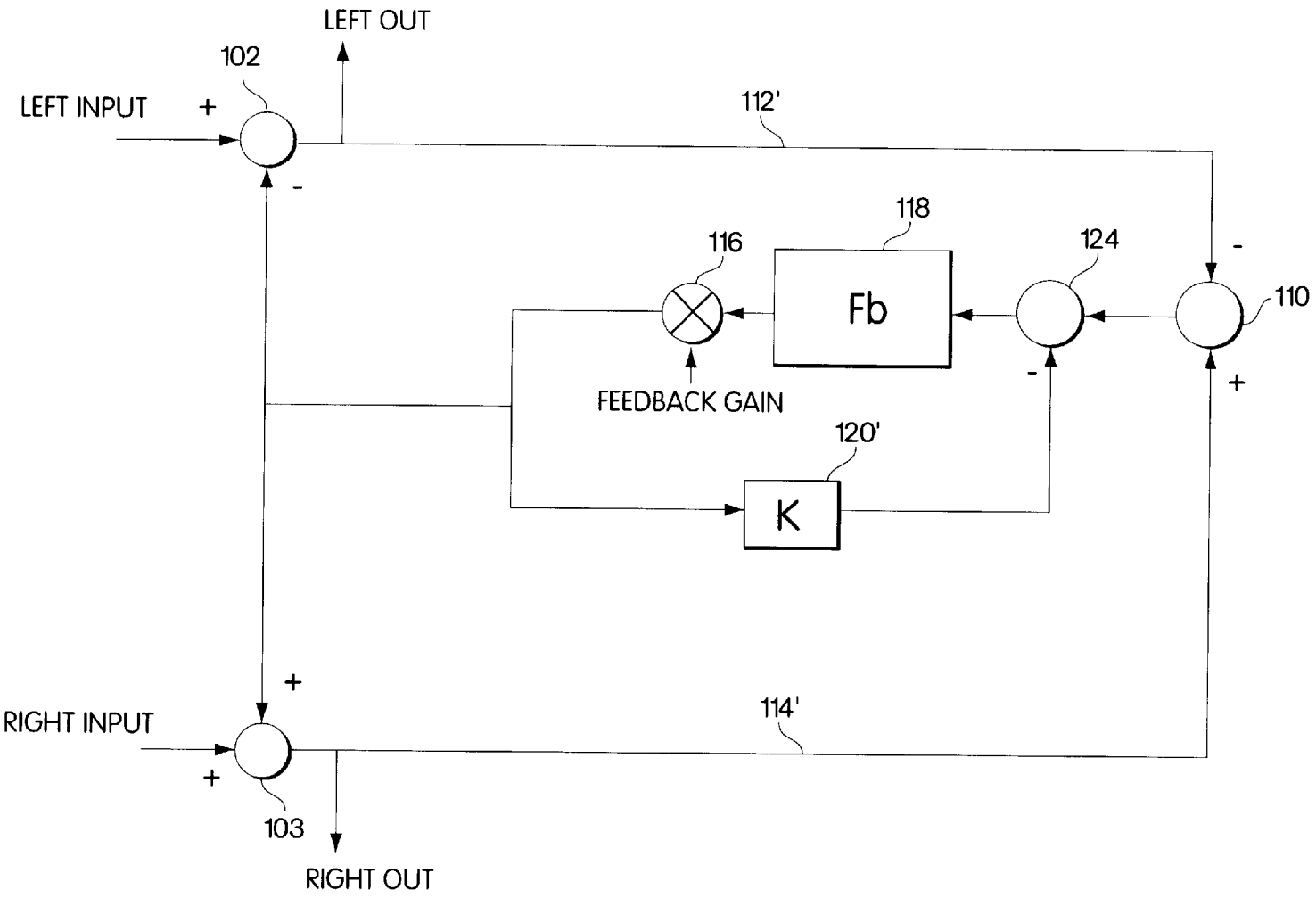
FIG. 9 is a simplified block diagram of FIG. 8.

FIG. 9 shows a circuit where the F1 and F2 transfer functions have been replaced by simple gain blocks. In particular, F1 filters 112, 122 and 114 are replaced by a gain of 1, as indicated by the solid lines at 112' and 114' and the elimination of block 122, and the F2 filter 120 is replaced by a gain of K, as indicated at 120'. Simulation of the acoustic signals arriving at the ear show that this system, with appropriate scalar gains, can be effective in increasing the phase shift between the two ear signals at low frequencies. The best performance was obtained with F1=1, and F1+F2=K=1.7, with the feedback gain 116 ranging from 0–6.

Figure 10:
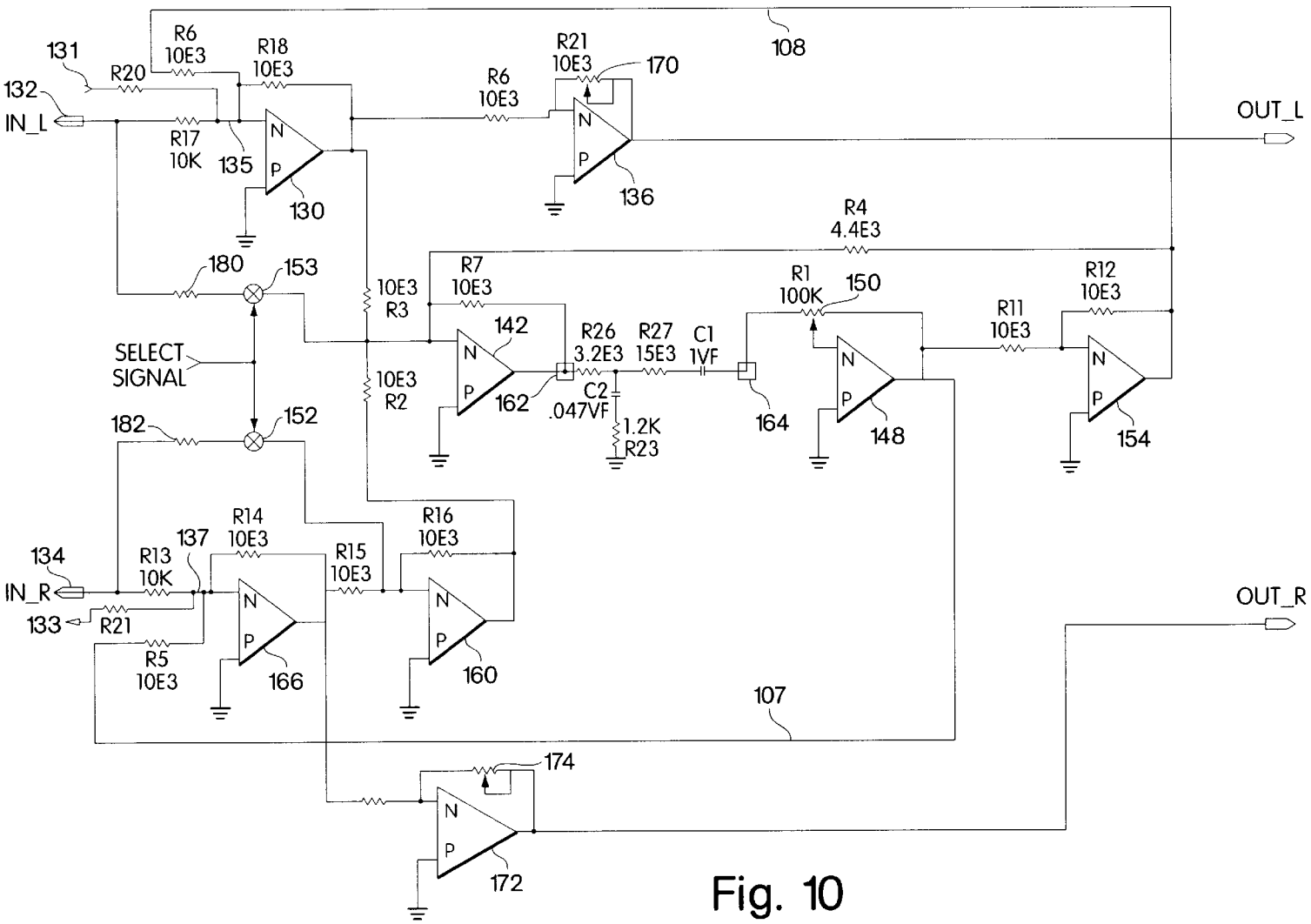
FIG. 10 shows an analog circuit according to FIG. 9.
Figure 11:
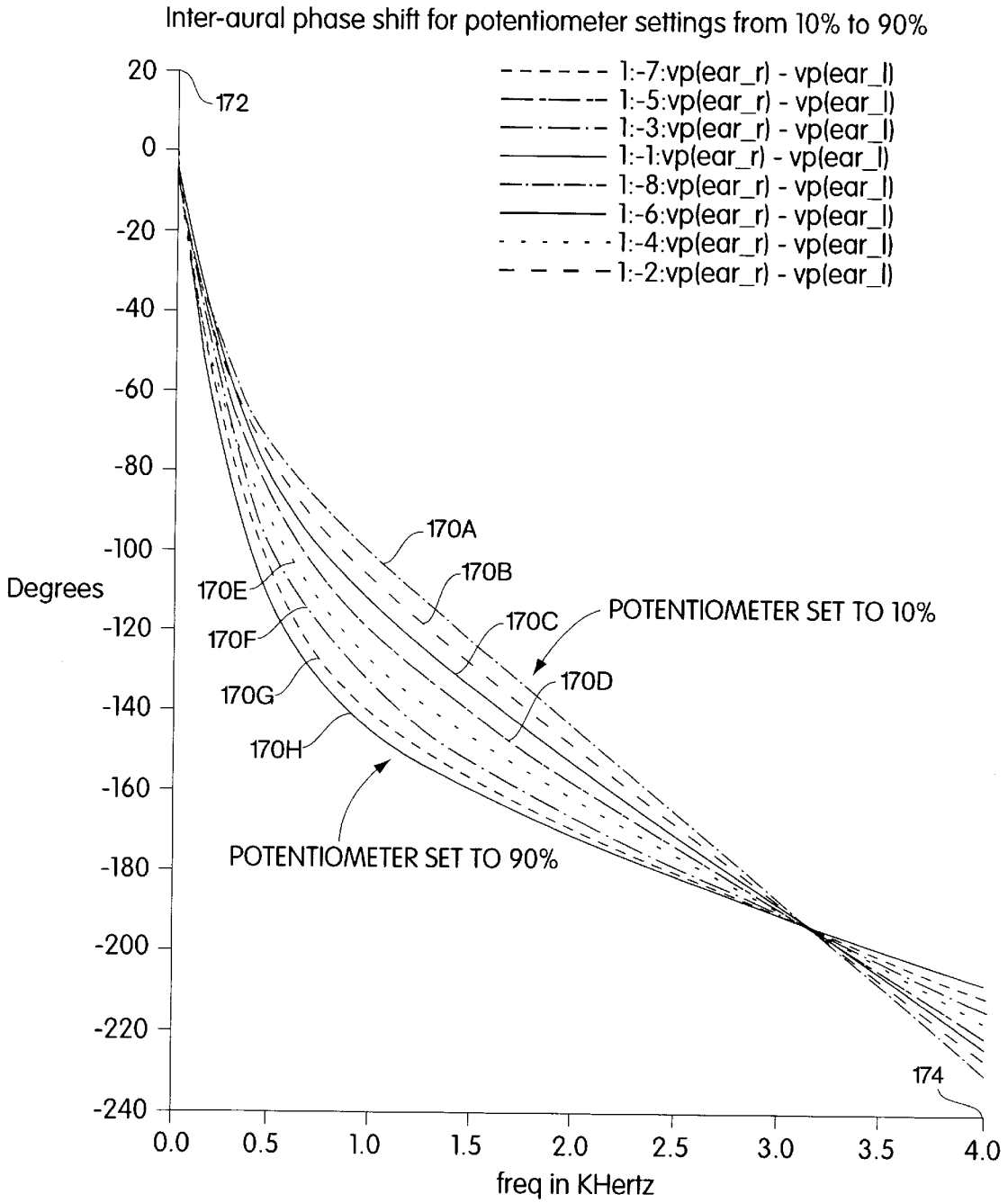
FIG. 11 is a graph illustrating phase shift with respect to frequency for different settings of the potentiometer shown in FIG. 10.

FIG. 10 shows a simple analog circuit implementation of the circuit described by FIG. 9. An additional feature present in this embodiment is the provision of two inputs, 131 and 132, on the left channel and two inputs, 133 and 134, on the right channel. The purpose and use of the additional channels 134 and 132 will be described in more detail below. Input channels 131 and 132 are added with a feedback signal 108 at a node 135 to which the signals are fed through resistors R6, R17 and R20. These resistors have an nominal value of 10 kOhms. An operational amplifier 130 receives the summed signal from node 135 and inverts it. This inverted signal is also applied to an inverter 136 with a variable gain, provided by a variable resistor 170, to provide volume control for the left channel output. Similarly, on the right channel, inputs 133 and 134 are summed with feedback signal 107 at node 137, to which the signals are connected via resistors R5, R13 and R21. This sum is inverted by inverter 166. The inverted signal is applied through another inverter 172 with a variable gain, provided by variable resistor 174, to provide volume control for the right channel output. The output of invertor 166 is also feed to another inverter 160. The output of inverters 160 and 130 are fed to a node 138 through resistors R2 and R3, which provides their sum. The feedback from an inverter 154 through resistor R4 provides a gain K (such as indicated at 120 in FIG. 9). This feedback value is summed at node 138 also. Operational amplifier 142 acts as an inverter which applies a signal to a filter, such as filter 118 in FIG. 9. In FIG. 11, this filter is defined by resistors R26, R27 and R23 and capacitors C1 and C2. An operation amplifier 148 having a variable resistor 150 provides the feedback gain 116 of FIG. 9. The output of operational amplifier 148 is feed to inverter 154 to be fed back to the left channel as signal 108 to provide the left channel output, whereas the output of operational amplifier 148 provides feedback signal 107 of the right channel output.

All of the resistors shown in FIG. 10, in this embodiment, have a nominal value of 10 kOhms, except for variable resistors 170, 174 and 150, resistor R4 (which provides the gain K), and resistors R27, R23 and R26 (of the feedback filter). Resistor R27 has nominal value of 15 kOhms, resistor R23 has an nominal value of 1.2 kOhms and resistor 26 has a nominal value of 3.2 kOhms. Capacitor C1 has an nominal value of 0.1 microfarads, whereas capacitor C2 has a nominal value of 0.047 microfarads.

The additional inputs 132 and 134 permit multiple input signals to be mixed where one signal is spatialized and the other is not. For example, by feeding channel 132 through a resistor to node 138, the contribution of this input signal 132 to the input of the feedback filter is canceled. Thus, the input signal 132 is not spatialized, but is fed only to the output. Similarly, by feeding input channel 134 through a resistor 182 to node 139, a similar effect is obtained. By attaching switches 152 and 153 to the feed forward lines related to channels 132 and 134, the signals on these channels can be selectively spatialized.

The circuit shown in FIG. 10 can be readily implemented as an integrated circuit. The input channels, the variability of the variable resistors 150, 174 and 170 and the control switches 152 and 153 can be provided as input pins to such an integrated circuit. Additionally, node 162 can be provided as an output pin and node 164 can be connected to an input pin to allow this circuit to be connected to any arbitrary filter.

FIG. 11 is a graph illustrating results of a simulation where electrical outputs are connected to a SPICE model of the speaker-to-ear transfer function including the cross-coupling terms with delays and filtering. Each plot 170A–170H shows the inter-aural phase shift (i.e., the phase at one ear subtracted from the phase at the other ear) in units of Degrees on the ordinate 172 as a function of the feedback gain 116 (FIG. 9), as set by the potentiometer 150 (FIG. 10), and as a function of frequency, in kilohertz, shown on the abscissa 174. With the gain set to zero, the phase shift corresponds to the normal speed-of-sound delay between the near and far ears for a single speaker at a 20° angle off of the center position. As the gain is increased, the phase difference between the ears is increased for frequencies below 2 kHz. This increasing phase shift causes the acoustic image to shift farther to the side of the listener, as the primary low-frequency localization mechanism for humans is the inter-aural phase shift.

The graph of FIG. 11 demonstrates that this system can be implemented with a simple variable gain to provide varying spatialization effects for a listener, or to provide adaptation to different playback environments. Through a simple adjustment of the electrical model of the speaker-to-ear transfer functions, this system automatically provides the desired ear signals. Since the adjustment simply changes an electrical model, it is possible dynamically to adapt the model to suit the position of the listener.

Additionally, sound recordings designed for a predetermined environment may be made by processing a stereo recording using a circuit in accordance with this invention having an electrical speaker-to-ear model of the predetermined environment. Such a recording may be particularly useful for computer-based multimedia works, where the likely user will be facing a computer with left and right speakers on opposite sides of a computer monitor directly in front of the user. The left and right output signals from the circuit can be recorded, for example as a computer data file or on a CD-ROM, for future playback in the predetermined environment.

Having now described a few embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention as defined by the appended claims and equivalent thereto.

What is claimed is:

1. A circuit for spatializing an audio signal defined by a first input signal and a second input signal to provide a spatialized output audio signal, comprising:

a first adder having a signal input connected to receive the first input signal, a feedback input and an output providing a sum of the first input signal and the feedback input;

a second adder having a signal input connected to receive the second input signal, a feedback input and an output providing a sum of the second input signal and the feedback input; and a filter having a first input connected to the output of the first adder, a second input connected to the output of the second adder, a first output connected to the feedback input of the first adder and a second output connected to the feedback input of the second adder, the filter including:

a third adder having a first input defining the first input of the filter, a second input defining the second input of the filter, a feedback input and an output providing the sum of the first input, the second input and the feedback input;

a second filter having an input connected to the output of the third adder and an output providing a filtered signal;

a first gain element having a gain, an input connected to the output of the second filter and an output; and a second gain element having a gain, an input connected to the output of the first gain element and an output connected to the feedback input of the third adder, wherein the outputs of the first and second adders provide the spatialized output audio signal.

2. The circuit of claim 1, wherein the filter defines a model of the speaker-to-ear transfer function.

3. The circuit of claim 1, wherein the gain of the first gain element is adjustable.

4. A circuit for spatializing an audio signal defined by a first input signal and a second input signal to provide a spatialized output audio signal, comprising:

a first adder having a signal input connected to receive the first input signal, a feedback input and an output providing a sum of the first input signal and the feedback input;

a second adder having a signal input connected to receive the second input signal, a feedback input and an output providing a sum of the second input signal and the feedback input; and a filter having a first input connected to the output of the first adder, a second input connected to the output of the second adder, a first output connected to the feedback input of the first adder and a second output connected to the feedback input of the second adder, the filter including:

a third adder having a first input defining the first input of the filter, a second input defining the second input of the filter, a feedback input and an output providing the sum of the first input, the second input and the feedback input;

a second filter having an input connected to the output of the third adder and an output providing a filtered signal;

a gain element having a gain, an input connected to the output of the second filter and an output; and a third filter having an input connected to the output of the gain element and an output providing a filtered signal to the feedback input of the third adder, wherein the outputs of the first and second adders provide the spatialized output audio signal.

5. The circuit of claim 4, further comprising:

a fourth filter having an input connected to the output of the first adder and an output connected to the first input of the third adder;

a fifth filter, having filter characteristics similar to the fourth filter, having an input connected to the output of the second adder and an output connected to the second input of the third adder; and wherein the third filter comprises:

a sixth filter connected to the output of the gain element to provide an output signal; and a seventh filter, having filter characteristics similar to the fourth filter, connected to the output of the gain element; and providing an output signal, combined with the output signal of the sixth filter to be applied to the feedback input of the third adder.

6. A circuit for processing an audio signal to provide a spatialized output signal, comprising:

an adder having a signal input for receiving the audio signal, a feedback input and an output providing a sum of the audio signal and the feedback input; and a filter having a first input connected to the output of the adder and an output connected to the feedback input of the adder, the filter including:

a second adder having a first input defining the first input of the filter, a second input and an output providing the sum of the first input and the second input;

a second filter having an input connected to the output of the second adder and an output providing a first filtered signal;

a gain element having a gain, an input connected to the output of the second filter and an output defining the output of the filter; and a third filter having an input connected to the output of the gain element and an output providing a second filtered signal to the second input of the second adder, wherein the output of the adder and the output of the filter provide the spatialized output signal.

7. The circuit of claim 6, wherein the filter defines a model of the speaker-to-ear transfer function.

8. The circuit of claim 6, wherein the filter further comprises a fourth filter connected to the output of the adder and having an output connected to the first input of the second adder.

9. The circuit of claim 6, wherein the gain of the gain element is adjustable.

10. A process for spatializing an audio signal defined by a first input signal and a second input signal to provide a spatialized output audio signal, comprising the steps of:

adding the first input signal and a first feedback input to provide a first output;

adding the second input signal and a second feedback input to provide a second output; and filtering a combination of the first output and the second output to provide the first feedback input and the second feedback input as an inverse of the first feedback input, including the steps of:

adding the first output, the second output and a third feedback input to provide a third output;

filtering the third output to provide a filtered signal;

applying a gain to the filtered signal to provide a scaled filtered signal as the first and second feedback inputs; and filtering the scaled filtered signal to provide the third feedback input, wherein the first and second outputs are the spatialized output audio signal.

11. The process of claim 10, wherein the step of adding the first output, the second output and a third feedback input comprises the steps of:

filtering the first output according to a first set of filter characteristics;

filtering the second output according to a second set of filter characteristics similar to the first set of filter characteristics; and adding the filtered first output, the filtered second output and the third feedback input to provide the third output, and wherein the step of filtering the scaled filtered signal comprises steps of:

filtering the scaled filtered signal to provide a first output signal;

filtering the scaled filtered signal according to a third set of filter characteristics similar to the first set of filter characteristics to provide a second output signal; and combining the first and second output signals to provide the third feedback input.

12. A process for spatializing an audio signal defined by a first input signal and a second input signal to provide a spatialized output audio signal, comprising the steps of:

adding the first input signal and a first feedback input to provide a first output;

adding the second input signal and a second feedback input to provide a second output; and filtering a combination of the first output and the second output to provide the first feedback input and the second feedback input as an inverse of the first feedback input, including the steps of:

adding the first output, the second output and a third feedback input to provide a sum of the first output, the second output and the third feedback input;

filtering the sum to provide a filtered signal;

applying a first gain to the filtered signal to provide the first and second feedback inputs; and applying a second gain to the filtered signal to provide the third feedback input, wherein the first and second outputs are the spatialized output audio signal.

13. The process of claim 12, wherein the step of filtering the combination of the first output and the second output defines a model of a speaker-to-ear transfer function.

14. The process of claim 12, wherein the first gain is adjustable.

15. A process for processing an audio signal to provide a spatialized output signal, comprising the steps of:

adding the audio signal to a feedback input to provide an output;

filtering the output to provide the feedback input, including the steps of:

adding the output and a second input to provide a sum of the output and the second input;

filtering the sum to provide a filtered signal;

applying a gain to the filtered signal to provide the feedback input; and filtering the feedback input to provide the second input, wherein the output and the feedback input provide the spatialized output signal.

16. The process of claim 15, wherein the step of filtering the output defines a model of a speaker-to-ear transfer function.

17. The process of claim 15, wherein the step of adding the output and a second input includes the steps of:

filtering the output to provide a first filtered signal; and adding the first filtered signal and the second input to provide the sum.

18. The process of claim 15, wherein the gain is adjustable.

* * * * *